US006565684B2

(12) United States Patent
Sigli et al.

(10) Patent No.: US 6,565,684 B2
(45) Date of Patent: May 20, 2003

(54) MANUFACTURING PROCESS FOR A HOLLOW PRESSURE VESSEL MADE OF ALZNMGCU ALLOY

(75) Inventors: Christophe Sigli, Grenoble (FR); Pierre Sainfort, Clermont-Ferrand (FR)

(73) Assignee: Societe Metallurgique de Gerzat, Paris (FR)

( * ) Notice: Subject to any disclaimer, the term of this patent is extended or adjusted under 35 U.S.C. 154(b) by 0 days.

(21) Appl. No.: 09/766,674

(22) Filed: Jan. 23, 2001

(65) Prior Publication Data

US 2001/0039982 A1 Nov. 15, 2001

(30) Foreign Application Priority Data

Feb. 23, 2000 (FR) ..... 00 02273

(51) Int. Cl.[7] ..... C22F 1/053
(52) U.S. Cl. ..... 148/690; 148/697; 148/701
(58) Field of Search ..... 148/690, 697, 148/701

(56) References Cited

U.S. PATENT DOCUMENTS 5,932,037 A * 8/1999 Holroyd et al. ..... 148/689

* cited by examiner

*Primary Examiner*—George Wyszomierski
*Assistant Examiner*—Janelle Combs-Morillo
(74) *Attorney, Agent, or Firm*—Dennison, Schultz & Dougherty

(57) ABSTRACT

A process for manufacturing a hollow pressure vessel, in which a billet is cast from an alloy with a composition in % by weight, Zn=6.25–8.0, Mg=1.2–2.2, Cu=1.7–2.8, Fe<0.20, Fe+Si<0.40, at least one of the elements selected from the group consisting of Cr, Zr, V, Hf and Sc in an amount of 0.05–0.3, and other elements <0.05 each and <0.15 total. The cast billet is homogenized with a temperature profile such that metal temperature is slightly less than incipient melting temperature at all times, cooled to ambient temperature and softening annealed for a duration of 20 to 40 h between 200 and 400° C. with cooling at a rate of less than 50° C./h down to a temperature of below 100° C., resulting in a billet hardness <54 HB. A slug is cut out of the softened billet, cold or slightly warm extruded with an extrusion start temperature <300° C., to form a casing which is necked, solution heat treated at a temperature slightly below the incipient melting temperature, for a duration sufficient to obtain an absolute value of specific energy associated with a DTA thermogram signal of less than 3 J/g, quenched in cold water, and aged at between 100 and 200° C. for a duration between 5 and 25 h.

13 Claims, 1 Drawing Sheet

MANUFACTURING PROCESS FOR A HOLLOW PRESSURE VESSEL MADE OF ALZNMGCU ALLOY

FIELD OF THE INVENTION

The invention relates to a manufacturing process for hollow pressure vessels, particularly compressed gas cylinders made of aluminum alloy AlZnMgCu, in other words in the 7000 series according to the Aluminum Association's nomenclature.

DESCRIPTION OF RELATED ART

The use of aluminum alloys in the 7000 series for manufacturing hollow pressure vessels has been known for many years; these alloys have a high mechanical strength in the heat treated temper, such that the weight of the manufactured product can be reduced. Manufacturing includes casting and homogenization of billets, reverse extrusion of a cylindrical casing, tapering of the cylinder neck and heat treating by solution heat treatment, quenching and aging. The other properties required for this application are formability, particularly for the cylinder necking operation, good resistance to stress corrosion and inter-crystalline corrosion, and obtaining a ductile behavior during bursting tests under internal hydraulic pressure.

Patent FR 2510231 filed by the applicant describes the use of a 7475 type alloy for this application with the following composition (% by weight):

Zn=5.6–6.1, Mg=2.0–2.4, Cu=1.3–1.7, Cr=0.15–0.25, Fe<0.10, Fe+Si<0.25. The reverse extrusion operation may be done hot or cold.

Patent EP 0081441 filed by the applicant describes a process for manufacturing high strength and high toughness extruded products made of 7049A alloy with the following composition:

Zn=7.2–9.5, Mg 2.1–3.5, Cu=1.0–2.0, Cr=0.07–0.17, Mn=0.15–0.25, Fe<0.10, Si<0.08, Zr=0.08–0.14.

The product is extruded at a temperature of the order of 400° C.

Patent EP 0257167 filed by the applicant describes the use of a 7060 alloy with the following composition:

Zn=6.25–8.0, Mg=1.2–2.2, Cu=1.7–2.8, Cr=0.15–0.28, Fe<0.20, Fe+Si<0.40, Mn<0.20.

Patent EP 0589807 is a variant of the previous patent in which Cr is replaced by Zr (0.10–0.25%). Cylinders made of 7060 are produced industrially by hot extrusion.

Patent application WO 94/24326 by Alcan International describes a process for manufacturing a hollow pressure vessel starting from an alloy with composition Zn=5.0–7.0, Mg=1.5–3.0, Cu=1.0–2.7, Fe<0.30, Si<0.15, a recrystallization inhibitor (particularly Cr or Zr) with a content 0.05–0.4, with a microstructure such that the fraction of the S phase ($CuMgAl_2$) by volume is kept below 1%, and preferably below 0.2%. According to the application, this microstructure is obtained by homogenization of the billet at about 475° C. with a low rate of temperature rise when getting close to this value. Preferably, for cost reasons, extrusion is done cold or slightly warm. Here, aging is an overaging which is applied such that the yield strength is about 20% below the peak to improve the toughness, fatigue resistance, and resistance to crack propagation and stress corrosion. An alloy with the claimed composition was subsequently recorded at the Aluminum Association with the designation 7032.

Patent application EP 0670377 made by Pechiney Recherche applies to alloys with a high mechanical strength and the following composition:

Zn=7–13.5, Mg=1.0–3.8, Cu=0.6–2.7, Mn<0.5, Cr<0.4, Zr<0.2 possibly transformed by extrusion to obtain hollow vessels. Homogenization and solution heat treating are carried out at 10° C. below and preferably 5° C. below the incipient melting temperature under conditions such that in T6 temper, the absolute value of the specific energy associated with the DTA (differential thermal analysis) signal is less than 3 J/g.

For some applications, it is desirable to use very high strength alloys to give the minimum weight of cylinders, and also to reduce manufacturing costs; for example this is the case for portable extinguishers. One means of lowering the cost is to use cold extrusion, in other words in which the metal at ambient temperature at the beginning of extrusion, or slightly warm extrusion in which the metal is heated before extrusion to a temperature of less than 300° C., which is significantly more economic than hot extrusion in which the metal is heated to between 350 and 450° C. before extrusion.

However, cold extrusion of high strength alloys such as 7060 causes very high extrusion forces that are often incompatible with extrusion presses usually used for this type of product, or in any case reducing the life of extrusion tools. Furthermore, application of the information in WO 94/24326 to the 7060 alloy concerning the billet homogenization temperature (more than 470° C.) often means that the alloy incipient melting temperature is reached during homogenization.

Thus, the purpose of the invention is to develop a procedure for manufacturing high strength hollow pressure vessels made of a 7000 alloy, such as 7060 alloy, by cold or slightly warm extrusion under acceptable industrial conditions, in order to give a high mechanical strength without prejudice to other properties required for this application.

SUMMARY OF THE INVENTION

The object of the invention is a process for manufacturing hollow pressure vessels, particularly compressed gas cylinders, comprising the following steps:

a) cast a billet using an alloy with the following composition (% by weight) Zn=6.25–8.0, Mg=1.2–2.2, Cu=1.7–2.8, Fe<0.20, Fe+Si<0.40, Mn<0.10, at least one of the elements belonging to the group consisting of Cr, Zr, V, Hf, Sc in the proportion 0.05–0.3, other elements <0.05 each and <0.15 total, b) homogenization of this billet using a temperature profile such that the metal temperature is slightly less than its incipient melting temperature at all times, c) softening annealing with a duration of 20 to 40 h between 200 and 400° C. with cooling at less than 50° C./h down to a temperature of below 100° C., such that the hardness <54 HB, d) cutout a slug, e) cold or slightly warm extrusion (extrusion start temperature <300° C.) of a casing, f) necking the casing, g) solution heat treting at a temperature slightly below the incipient melting temperature, with a duration such that the absolute value of the specific energy associated with the DTA signal is less than 3 J/g (and preferably <2 J/g)

h) quenching in cold water, i) aging at between 100 and 200° C. for a duration between 5 and 25 h.

DESCRIPTION OF THE INVENTION

The chemical composition of the alloy is within the limits defined in patents EP 0257167 (chromium alloy) and EP 0589807 (zirconium alloy). Chromium and zirconium may be replaced by vanadium, hafnium or scandium. Preferably, the contents will be (individually or in combination) Zn>6.75%, Mg<1.95%, Fe<0.12%, Fe+Si<0.25%, Mn<0.10%.

The alloy is cast in billets in a manner known per se, for example by semi-continuous casting.

Homogenization is done with a temperature profile such that the alloy temperature is a few degrees C below the incipient melting temperature of the alloy, that may vary from 470 to 485° C. depending on the alloy composition, at all times. It is important that homogenization is sufficient, otherwise there is a risk of seeing cracks appearing during extrusion due to the alignment of coarse copper phases (for example AlCuZn) and causing dissolution of local melting, leading to decohesions, burning or porosity. The homogenization quality may be evaluated by differential enthalpic analysis. Insufficient homogenization will cause initial melting with a large endothermic peak, indicating metastable eutectic melting (αAl+S, M, T). It can be estimated that this quality is good when, as described in patent EP 0670377, the DTA thermogram indicates an absolute value of the specific energy associated with the melting peak equal to less than 3 J/g, and preferably less than 2 J/g. It will also be possible to make this check on the solution heat treated product only, and then judge the quality of the homogenization—solution treatment pair.

It is important that the incipient melting temperature should not be reached if good ductility is to be obtained. Preferably, this is done by homogenization in two isothermal steps at increasing temperatures. The temperature of the first step also depends on the alloy composition. It is estimated that if the composition is such that %Mg<0.5%Cu+0.15Zn, the temperature of the first step must not exceed 465° C., and when Mg>0.5Cu+0.15Zn, it must not exceed 470° C.

The hardness of billets homogenized in this manner is high and very large forces on the press are necessary during cold or slightly warm extrusion, which reduces the life of tools. This is why it is essential to perform softening annealing that produces an acceptable hardness level, that may be equal to 54 HB, this Brinell hardness being measured with a 2.5 mm diameter ball and a 62.5 kg load. This annealing preferably includes several isothermal steps at decreasing temperatures between 400 and 200° C. with a total duration of between 20 and 40 h followed by a fairly slow temperature drop, less than 50° C./h, down to a temperature <100° C. The hardness obtained on softened billets no longer changes by maturation at ambient temperature.

The softened billets are then cut into slugs corresponding to the quantity of metal necessary to obtain a cylinder blank in the form of a cylindrical casing by cold or slightly warm extrusion. A tapering operation is performed that consists of forming the cylinder neck by necking.

The part obtained is then solution heat treated at a temperature as close as possible to the incipient melting temperature of the alloy, while avoiding burning. The solution heat treatment quality, that depends both on the quality of prior homogenization and the solution treatment conditions themselves, is also evaluated by differential enthalpic analysis on samples in the T6 temper. The specific energy (absolute value) associated with the melting peak of the DTA thermogram must be less than 3 J/g and preferably <2 J/g, regardless of the location from which the sample is taken on the cylinder. The result may be different for the top and bottom of the cylinder due to the difference in the cooling rate during quenching. If the cylinder is dipped into the quenching liquid with the top part first, then the top will be cooled quickly whereas the bottom will be cooled more slowly.

Aging is done at a temperature of between 100 and 180° C. for a duration of between 5 and 25 h. This aging preferably consists of two isothermal steps at increasing temperatures, the first at a temperature of between 100 and 120° C. for 4 to 8 h, and the second at a temperature of between 150 and 180° C. for between 5 and 20 h. This aging must be done to give a good compromise between the mechanical strength that decreases when aging is done for a longer period, and resistance to corrosion and particularly stress corrosion, that increases with averaging. After aging, the result is a recrystallized fine grain structure that gives excellent ductility.

The process according to the invention can give a remarkable set of properties, namely ultimate tensile strength Rm>490 MPa, guaranteed yield strength $R_{0.2}$>460 MPa, elongation A>12%, lack of inter-crystalline corrosion, no break at 30 days due to stress corrosion at 350 MPa, while using a cold or slightly warm extrusion technique that is more economic than hot extrusion under acceptable industrial conditions.

The process is applicable to the manufacture of high pressure cylinders designed particularly for extinguishers, gas for breweries, breathing apparatus, industrial gases. It is economically adapted to the production of cylinders for single use only, which simplifies distribution. It is also applicable to the manufacture of metallic liners for composite wound cylinders using glass, carbon or aramid fibers.

EXAMPLES

Example 1

Influence of Homogenization

Figure 1:
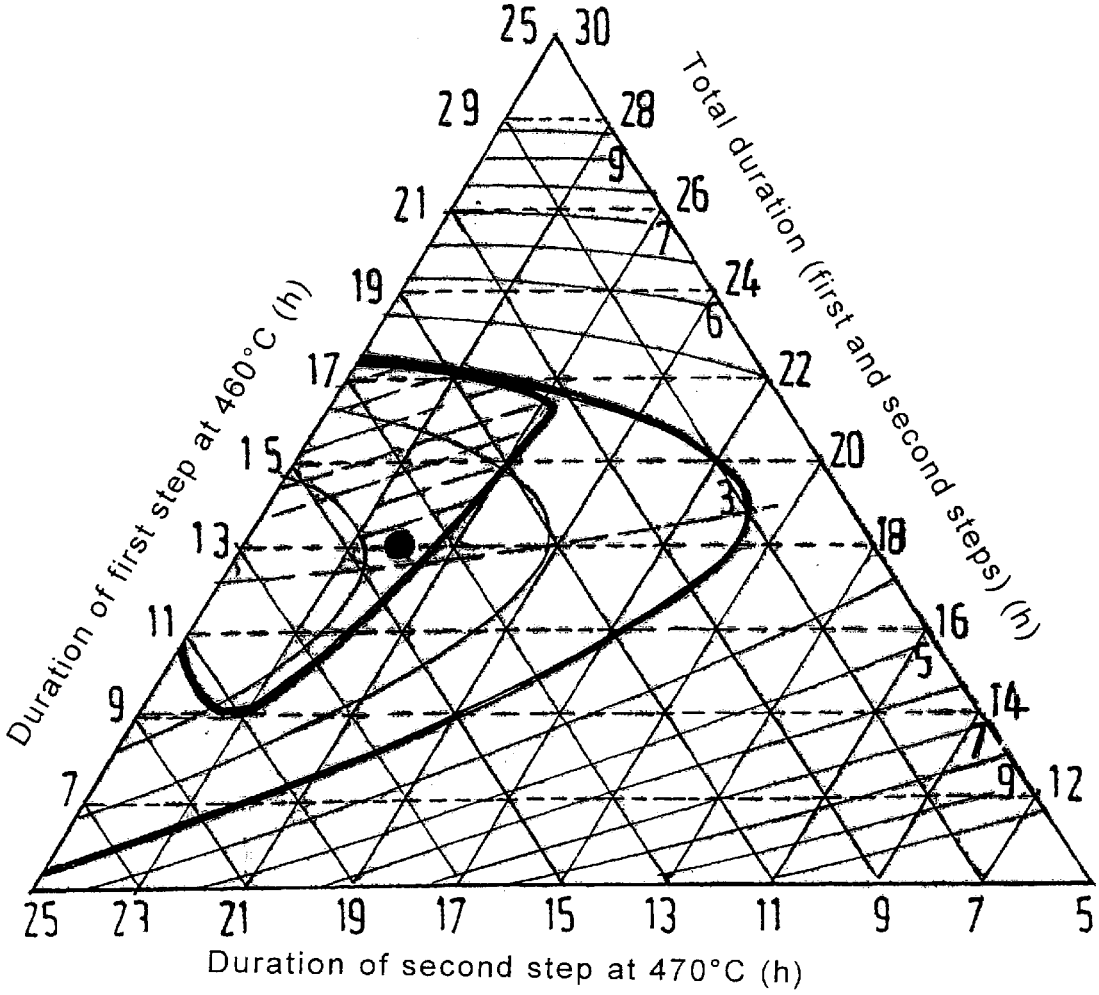
FIG. 1 is a graph showing the influence of homogenization time on microstructure for the samples described in Example 1 and in Table 1.

Billets were cast made of 7060 alloy with the following composition (% by weight):

Si=0.02, Fe0.04, Cu=2.07, Zn=6.92, Mg=1.76, Cr=0.20.

These billets were homogenized in two steps with a first step at 460 or 465° C. and a second step at 470° C., by varying the duration of each of the steps according to a predetermined experience plan. For each homogenization treatment, a micrographic examination was made to evaluate fragmentation and resorption of the copper phases at 4 mm from the edge of the billet. Micrographies were classified according to a qualitative index from 1 (very good) to 7 (bad). Table 1 gives the various homogenization treatments and the corresponding qualitative index.

TABLE 1

| Mark | Homogenization | Total time | Index |
|---|---|---|---|
| 1 | 5 h 465° + 25 h 470° | 30 h | 1 |
| 2 | 19 h 465° + 9 h 470° | 28 h | 1 |
| 3 | 11 h 460° + 13 h 470° | 24 h | 2 |
| 4 | 11 h 460° + 19 h 470° | 30 h | 3 |
| 5 | 11 h 465° + 13 h 470° | 24 h | 3 |
| 6 | 5 h 460° + 19 h 470° | 24 h | 4 |
| 7 | 17 h 460° + 13 h 470° | 30 h | 4 |
| 8 | 11 h 460° + 7 h 470° | 18 h | 5 |
| 9 | 17 h 460° + 7 h 470° | 24 h | 6 |
| 10 | 7 h 465° + 9 h 470° | 16 h | 6 |
| 11 | 5 h 460° + 13 h 470° | 18 h | 7 |
| 12 | 5 h 460° + 25 h 470° | 30 h | 7 |

The results were validated by image analysis and led to a recommended area represented in a triangular diagram shown in FIG. 1, the coordinates of which are the time of the first step at 460° C., the time of the second step at 470° C., and the total time. It is found that a total time of more than 26 h is necessary and sufficient for a good homogenization quality. An optimized set value for this treatment consists of a first 13 h step at 460° C. and a second 14 h step at 470° C.

The DTA measurements confirm that the peak associated with the melting energy has practically disappeared and the energy associated remains less than −0.20 J/g regardless of the location at which the sample is taken in the billet. In the lack of homogenization, the incipient melting temperature is of the order of 467° C. and the area of the peak is of the order of −15 J/g.

The fraction by volume of the S phase that was 1.5% in the unfinished relaxation state, is equal to 0.62% at the end of the first step at 460° C., and 0.17% at the end of the second step.

Example 2

Influence of Softening

Billets made from the same alloy as in the previous example were homogenized according to the defined set value for 13 h at 460° C.+14 h at 470° C. After returning to ambient temperature, the hardness is greater than 70 HB. This hardness is not stable and increases with time. In order to soften the billet before extrusion, an annealing treatment was applied with a 3 h step at 400° C., a 6 h step at 300° C., a 6 h step at 230° C., and cooling at a rate of 20° C./h until the metal temperature drops below 100° C. The hardness of the billet after reaching ambient temperature is 52 HB, and this does not change with time. This invariance in the hardness with time indicates that the softening treatment is efficient.

Example 3

Influence of Aging 153 mm diameter billets were cast with the following composition (% by weight):

Si=0.02, Fe=0.040, Cu=2.06, Mg=1.67, Zn=7.14, Cr=0.20.

These billets were homogenized by a two-step treatment for 13 h at 460° C. and 14 h at 470° C. They were then softened by the treatment described in the previous example and then cut into 3.35 kg slugs to be cold extruded to form a casing which, after the neck has been drawn and tapered, is transformed into a cylinder body to contain compressed or liquefied gases with a capacity of 3 l, outside diameter 117 mm, length 432 mm, and designed to resist a test pressure of 205 MPa after heat treatment.

These cylinders were solution heat treated by a 2 h treatment at 475° C. The solution treatment quality of the entire cylinder was evaluated by differential enthalpic analysis using a Perkin-Elmer DSC7 instrument with a temperature rise rate of 20° C./min. Samples were taken on the outside and inside of the cylinder, at the top, middle and bottom. The results are shown in table 2.

TABLE 2

| Edge sample | Sample height | Peak start temp ° C. | Peak area (J/g) |
|---|---|---|---|
| Outside | Top | 452.0 | −0.13 |
| Outside | Middle | 453.8 | −0.10 |
| Outside | Bottom | 451.3 | −0.21 |
| Inside | Top | 449.5 | −0.19 |
| Inside | Middle | 450.0 | −0.09 |
| Inside | Bottom | 449.5 | −0.25 |

The differential enthalpic analysis shows the good solution treatment quality in all parts of the cylinder. The absolute values of all peak areas are less than 1 J/g, although the absolute values corresponding to the bottom of the cylinder are slightly higher than the absolute values corresponding to the middle or top of the cylinder.

After solution treatment and maturation at ambient temperature for at least 72 h, the cylinders were dipped into a cold water tank and were then aged in two steps with a first step of 6 h at 105° C. and a second step at 160, 165 or 170° C. lasting for 10, 13.5 or 17 h. In all nine cases, the ultimate tensile strength $R_m$ (in MPa), the 0.2% yield strength $R_{0.2}$ (in MPa), the elongation A (in %) and the electrical conductivity (in MS/m) were measured, using test pieces taken from the mid-height of the cylinder body in the longitudinal direction over the full thickness. The results are given in table 3:

TABLE 3

| 2nd annealing step | $R_m$ MPa | $R_{0.2}$ MPa | A % | Conductivity MS/m |
|---|---|---|---|---|
| 10 h 160° | 554.7 | 514.0 | 13.8 | 22.5 |
| 13.5 h 160° | 542.0 | 498.3 | 16.4 | 23.0 |
| 17 h 160° | 520.7 | 465.0 | 14.8 | 23.8 |
| 10 h 165° | 519.3 | 463.3 | 14.4 | 23.8 |
| 13.5 h 165° | 501.7 | 442.7 | 14.9 | 24.2 |
| 17 h 165° | 485.7 | 419.0 | 16.3 | 24.5 |
| 10 h 170° | 491.3 | 424.3 | 14.9 | 24.5 |
| 13.5 h 170° | 486.0 | 414.7 | 12.5 | 24.8 |
| 17 h 170° | 471.7 | 397.3 | 14.5 | 25.1 |

Micrographies were made using an optical microscope on mechanically polished samples taken on the external wall, at mid thickness and on the internal wall of the cylinder. They showed no signs of incipient melting of the eutectics.

Regardless of the aging that is done, there is no intercrystalline corrosion during the test according to European directive No. 84/526/CE (appendix 2). The behavior under stress corrosion was also observed according to the same standard on three test pieces to which the same stresses were applied for each aging type. No break was observed after 30 days at stresses of 286, 316 and 353 MPa. Considering the EEC directive authorizing a minimum guaranteed yield strength equal to 1.3 times the stress corrosion resistance, a yield strength of 460 MPa can be guaranteed and can be easily achieved with the aging treatments defined in the first four lines in table 3. In particular, aging for a second 10 h step at 165° C. gives an excellent compromise between the mechanical strength and the resistance to stress corrosion.

What is claimed is:

1. A process for manufacturing a hollow pressure vessel, comprising the steps of:

a) casting a billet from an aluminum alloy with a composition consisting essentially of, in % by weight, Zn=6.25–8.0, Mg=1.2–2.2, Cu=1.7–2.8, Fe<0.20, Fe+Si<0.40, at least one of the elements selected from the group consisting of Cr, Zr, V, Hf, Sc in an amount of 0.05–0.3, and other elements <0.05 each and <0.15 total, remainder Al;

b) homogenizing the billet with a temperature profile such that metal temperature is slightly less than incipient melting temperature at all times;

c) returning the homogenized billet to ambient temperature, then softening annealing the homogenized billet for a duration of 20 to 40 h between 200 and 400° C., followed by cooling at a rate of less than 50° C./h down to a temperature of below 100° C., resulting in a billet hardness <54 HB;

d) cutting a slug out of the softened billet;

e) cold or slightly warm extrusion of the slug, with an extrusion start temperature <300° C., to form a casing;

f) necking the casing;

g) solution heat treating the casing at a temperature slightly below the incipient melting temperature, for a duration sufficient to obtain an absolute value of specific energy associated with a DTA thermogram signal of less than 3 J/g;

h) quenching the solution heat treated casing in cold water; and i) aging the quenched casing at between 100 and 200° C. for a duration between 5 and 25 h.

2. Process according to claim 1, wherein Zn<6.75%.

3. Process according to claim 1, wherein Mg<1.95%.

4. Process according to claim 1, wherein Fe<0.12% and Fe+Si<0.25%.

5. Process according to claim 1, wherein Mn<0.10%.

6. Process according to claim 1, wherein the homogenization is sufficient that specific energy associated with a DTA thermogram melting peak is <3 J/g.

7. Process according to claim 1, wherein homogenization is performed in two isothermal steps of increasing temperature.

8. Process according to claim 7, wherein Mg <(0.5Cu+0.15Zn) and the temperature of the first of the isothermal steps is <465° C.

9. Process according to claim 7, wherein Mg<(0.5Cu+0.15Zn) and the temperature of the first of the isothermal steps is <470° C.

10. Process according to claim 1, wherein the softening annealing is performed in isothermal steps at decreasing temperature.

11. Process according to claim 7, wherein said aging comprises two isothermal steps, the first at a temperature between 100 and 120° C. and lasting between 4 and 8 h, and the second at a temperature between 150 and 200° C. and lasting between 5 and 20 h.

12. Process according to claim 7, wherein the hollow pressure vessel is a compressed gas cylinder.

13. Process according to claim 7, wherein the specific energy is <2/Jg.

* * * * *